US006554386B2

(12) United States Patent
Classens et al.

(10) Patent No.: US 6,554,386 B2
(45) Date of Patent: Apr. 29, 2003

(54) PRINTING PROCESS AND PRINTER SUITABLE FOR PERFORMING THE PROCESS

(75) Inventors: Wilhelmus Peter Johannes Classens, Castenray (NL); Hendricus Gerardus Josef Boerstal, Helden (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 09/994,208

(22) Filed: Nov. 28, 2001

(65) Prior Publication Data

US 2002/0075343 A1 Jun. 20, 2002

(30) Foreign Application Priority Data

Nov. 29, 2000 (NL) ..... 1016734

(51) Int. Cl.[7] ..... B41J 29/38; B41J 29/393
(52) U.S. Cl. ..... 347/17; 347/19; 347/14
(58) Field of Search ..... 347/17, 14, 19, 347/23, 12, 10, 11, 8, 20, 40, 42, 88, 60, 85

(56) References Cited

U.S. PATENT DOCUMENTS 5,049,898 A * 9/1991 Arthur et al. ..... 347/19
6,033,065 A 3/2000 Ikezaki ..... 347/88
6,086,194 A 6/2000 Ikezaki

FOREIGN PATENT DOCUMENTS

WO 96/14989 5/1996
WO 96/36490 11/1996

* cited by examiner

*Primary Examiner*—Lamson Nguyen
*Assistant Examiner*—Charles W. Stewart, Jr.
(74) *Attorney, Agent, or Firm*—Birch, Stewart, Kolasch & Birch, LLP

(57) ABSTRACT

A method of printing a receiving material using an ink jet printer provided with a print head having at least one print element, the print head being fixed on a support element, wherein the print head is heated to a working temperature higher than room temperature, moving the support element with respect to the receiving material in a main scanning direction and in a sub-scanning direction, image-wise actuation of the print element so that ink drops are ejected from the print head in the direction of the receiving material, and guaranteeing that the position that the print head occupies with respect to a fixed point on the support element during the printing of the receiving material is substantially a predetermined position.

10 Claims, 4 Drawing Sheets

PRINTING PROCESS AND PRINTER SUITABLE FOR PERFORMING THE PROCESS

BACKGROUND OF THE INVENTION

The present invention relates to a method of printing a receiving material using an ink jet printer provided with a print head having at least one print element, said print head being fixed on a support element, the method comprising heating the print head to a working temperature higher than room temperature, moving the support element with respect to the receiving material in a main scanning direction and in a sub-scanning direction, and image-wise actuation of the print element so that ink drops are ejected from the print head in the direction of the receiving material. The invention also relates to an ink jet printer suitable for performing this method.

A method and ink jet printer of this kind are known from U.S. Pat. No. 6,086,194. In this method, an ink jet printer is used which has four print heads fixed on a support element. Each of the print heads comprises a row of print elements disposed parallel to the sub-scanning direction. The print heads themselves are distributed over a row extending parallel to the main scanning direction. Each of the print heads contains a hot melt or phase change ink of a different colour, namely cyan, magenta, yellow and black. During the printing of an image, each of the print heads will print a sub-image in the corresponding colour. By arranging the support element to make a number of scanning passes in the main scanning direction and conveying the receiving material in the sub-scanning direction it is possible to print the entire receiving material with the relatively small print heads. At the back the support element is provided with an active heating means divided up into twelve heating zones made up of four rows in the main scanning direction and three in the sub-scanning direction. The heating zones have a smaller heating power the closer they are to the centre of the support element. The object of this configuration is to heat the print heads uniformly. This is important, because the printing properties of each of the print elements depends greatly on the local temperature of the print head of which the relevant print element forms part.

The known method has one significant disadvantage. It has been found that when this method is used all kinds of print artefacts may form depending on the circumstances during the printing of the receiving material, particularly the type of image printed, the printer settings and the ambient conditions. For example, it has been found that the subimages printed with each of the print heads and together forming the intended image on the receiving material, do not always adjoin one another accurately. There may also be disturbing patterns forming in the image. These and other print artefacts are visible particularly in the case of photographs or similar graphic images and full-colour pictures.

The object of the invention is to provide a method with which print artefacts are avoided are far as possible, and to provide a printer with which this method can be performed. To this end, a method has been discovered according to the preamble of claim 1, which is characterised in that the method further comprises guaranteeing that the position that the print head occupies with respect to a fixed point on the support element during the printing of the receiving material, is substantially a predetermined position. In addition, an ink jet printer has been invented according to the preamble of claim 5, which is characterised in that the printer comprises a guarantee means to gurantee that the position that the print head occupies with respect to a fixed point of the support element during the printing of the receiving material is substantially a predetermined position.

The invention is based on the recognition of the problem that the print head, depending on circumstances, occupies a different position with respect to a fixed point of the support element. Since the print element in turn occupies a fixed position in the print head, the result of this problem is that the position occupied by the print element with respect to the receiving material during the printing thereof is not unambiguously determined. This can be considered as follows. During the printing of the receiving material, a fixed point of the support element (for example a marker which may or may not in turn form part of a carriage) is used to determine the location of the print head at any time. The time when a print element is to be actuated is then derived from this in order to ensure that the corresponding ink drop precisely reaches the correct location on the receiving material. However, with the known actuation, no consideration is given to the fact that the position of the print head on the support element is itself dependent on the instantaneous circumstances. The result is that the ink drop, as soon as the position of the print head with respect to the fixed point on the support element deviates from a normal position, reaches a different location on the receiving material. If this deviation is sufficiently large, it is visible to the human eye and will therefore lead to print artefacts.

Research by the Applicants has shown that the said position dependent upon the circumstances can specifically be related to expansion and shrinkage of the support element. It has been found that in the method known from the above-mentioned patent, the support element assumes a temperature deviating from the set value, at least locally, depending on the circumstances. As a result, the dimensions, and in this case the geometry of the support element and hence also the position occupied by the print head on the support element with respect to the fixed point, undergo changes. This uncertain position can then lead to visible print artefacts because the position of the print element has also become uncertain as a result.

The fact that the known method can give rise to a deformation of the support element of this kind can be understood from the following. The known method is aimed at heating the print heads uniformly. For this purpose the above-mentioned heating zones are disposed at the back of the support element, each of the zones having a fixed heating power. In addition, the heating of the print heads is controlled by feeding to the print heads hot ink of a preset temperature. By measuring both the temperature of the support element and the temperature of the ink, and adjusting these two temperatures to a predetermined set temperature through the agency of independent heating means, the method is intended to ensure that the print heads and hence also the support element are uniformly heated. However, this objective does not appear to be achieved in all circumstances. If, for example, much less printing is carried out with one of the print heads than with each of the other print heads, it has been found that the support element no longer assumes a uniform temperature. This situation occurs, for example, if a full-colour image is printed in which there is little black. Each of the four print heads will lose heat by convection, radiation and conduction. To some extent this is compensated by the supply of new ink which has a temperature equal to the set temperature of the print heads. To another extent it will be compensated by the heating means disposed at the back of the support element. Since, however, the black print head hardly receives a supply of hot ink, this head will therefore miss one of the two heat flows and accordingly cool off with respect to the other print heads. The temperature sensor will not pick up this cooling with respect to the other heads. After all, the temperature of the support element is measured at the colour heads which will cool off to a much less degree as a result of the printing, for the reasons described above. Even by measuring the temperature of the black ink supply it will not be possible to detect the cooling of the black head because this ink supply is kept at the set temperature by independent heating means. The result of the relative cooling of the black print head, which is extra intense because this head is mounted on the outside of the support element and hence loses more heat via convection and radiation, is that the support element, which is in thermal conduction with the print head, will also cool off at the location of this head. As a result the support element shrinks (assuming that this element is made of a material having a positive coefficient of expansion) with the result that the position of the black print head with respect to the fixed point of said element and hence also with respect to the other print heads will change. The result is that further sub-images printed with the black print head will no longer adjoin the colour images, because the position of the print element with respect to the receiving material will be different from what the printer control will assume. As a result, visible white lines for example may form between a colour surface and a black line which is intended to surround said surface.

Not only the type of image as described above, but other circumstances such as ambient conditions (temperature, draught, other equipment in the vicinity), the set printing speed, the set printing quality, and so on, may result in the support element not having a constant geometry in the known method, so that the position of each of the print heads can vary with respect to a fixed point of said element. This problem is addressed in the method according to the invention. In this way, during the printing of the receiving material, the position occupied by each of the print heads with respect to a fixed point on the support element is known beforehand. As a result, print artefacts can also be reduced in simple manner.

A method of preventing deviant print positions from occurring as a result of temperature and moisture is also known from Japanese Patent Application 60-222258 (A). In this method, a test pattern is printed from which it is deduced whether there are any deviations and how great they are. This is then taken into account in actuating the print element. The first disadvantage of this method is that detection as to whether there is any deviation in the dot position is carried out at one specific moment so that it is not possible to guarantee that there were no deviations before then or no further deviations will occur thereafter. Another disadvantage of this method is that the actuation of the print element is rendered dependent on the measured value. This makes the actuation complex and hence expensive. This application neither discloses nor suggests that an important cause of the deviations is a variable position of the print head on the support element.

In a further embodiment of the method according to the invention, a predetermined temperature profile is substantially imposed on the support element during the printing of the receiving material. In this embodiment, an important cause of a variable position of the print head is eliminated. By imposing a predetermined temperature profile on the support element, its geometry is fixed. As a result, the position of the print head is also fixed with respect to the fixed point on the support element as is also the position of the print element. Thus actuation of the print element does not need to take into account any deviant position. By imposing this temperature profile under all feasible circumstances, the position of the print head on the support element is at all times the same, so that the above-mentioned print artefacts can be avoided. In a following embodiment of the method, the temperature profile comprises a temperature higher than room temperature. Since the print head is heated, heat will almost inevitably leak to the support element. By imposing on the support element a temperature higher than room temperature it is possible to reduce the quantity of heat leaking from the print head to the support element. This has the advantage that the print head can be kept at the working temperature more easily. In addition, it has been found that in this way it is simpler to guarantee that the position occupied by the print head during the printing of the receiving material is substantially a predetermined position with respect to a fixed point on the support element: by avoiding excessive heat flow to the support element at the location of the print head it is possible to impose a predetermined temperature profile with simpler means because the dynamics in the heat flows in this embodiment are reduced. In another embodiment, the temperature imposed on the support element is substantially equal to the working temperature of the print head. The heat flow to the support element is further avoided in this way. In this embodiment, the temperature imposed on the support element, preferably in the neighborhood of the print head, will be substantially the same as that of the print head.

In a further embodiment of the ink jet printer according to the invention, at least two print heads are fixed on the support element. It has been found that particularly with these ink jet printers the said print artefacts occur due to the problem recognized by the Applicants. A deviation in the mutual position of the print heads evidently results relatively rapidly in visible print artefacts so that particularly with this type of ink jet printer the invention can ensure an appreciable improvement of the print quality. In this embodiment one of the two print heads would be able to serve as fixed point. In this way the mutual distances between the print heads during printing is always the same so that a significant proportion of print artefacts can be avoided.

In another embodiment of the ink jet printer according to the invention, the print heads are fixed on the support element at least in the main scanning direction. In this type of ink jet printer, the print heads are disposed next to one another in the main scanning direction so that the support element has a length direction in the main scanning direction. This layout inter alia offers the advantage that the ink jet printer can be made compact. The problem recognised by the Applicants will occur particularly in the main scanning direction in this printer. The invention addresses this problem so that the advantages of a printer configuration of this kind can be fully utilised without an unnecessary number of disturbing print artefacts forming.

BRIEF DESCRIPTION OF THE DRAWINGS

The present invention will now be explained further with reference to the following drawings, wherein.

DETAILED DESCRIPTION OF THE INVENTION

Figure 1:
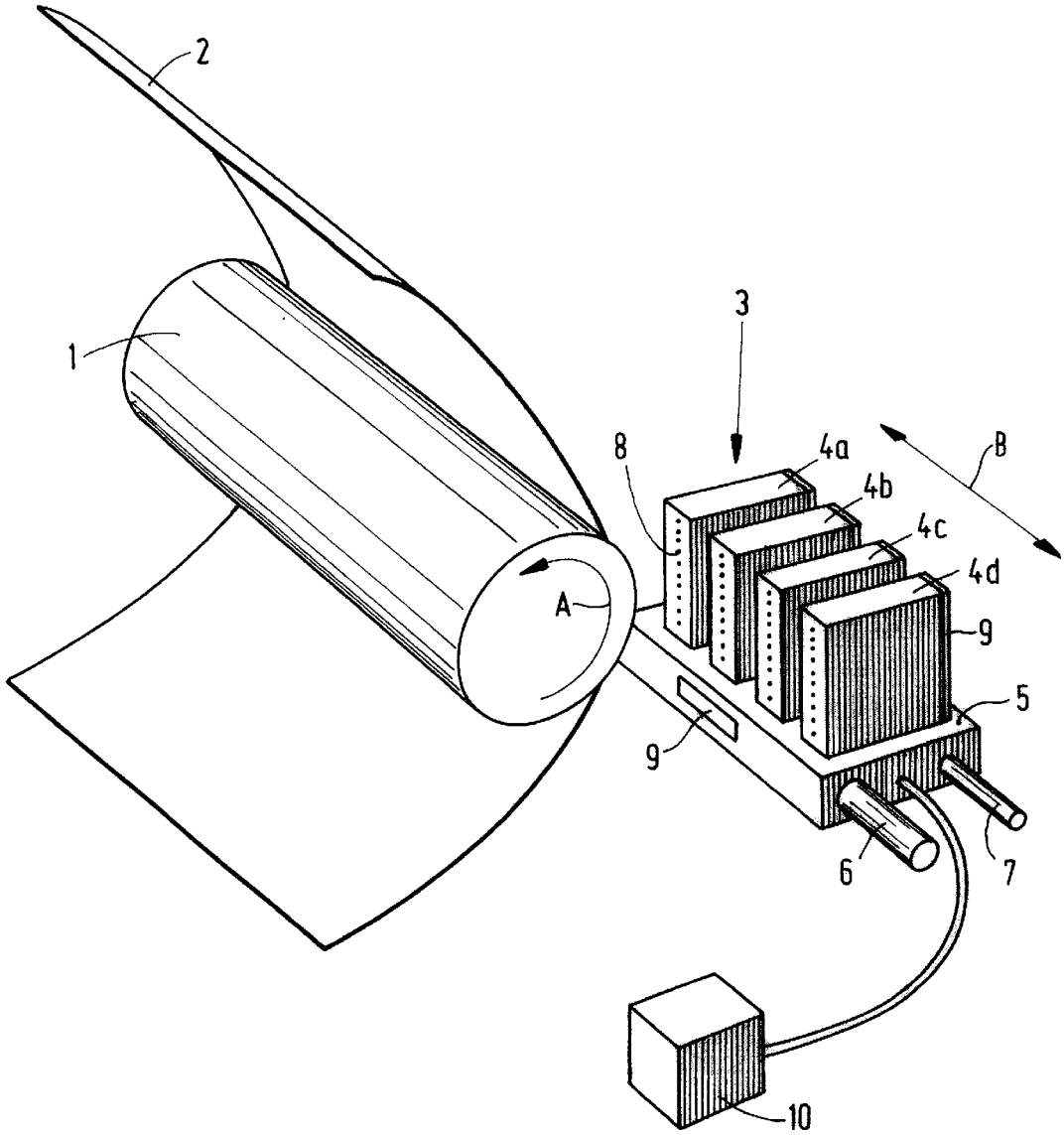
FIG. 1 is a diagram of an ink jet printer.

FIG. 1 diagrammatically illustrates an ink jet printer. In this embodiment, the printer comprises a roller 1 to support a receiving material 2, for example a sheet of paper or a transparent sheet, and guide it along the scanning carriage 3. This carriage comprises a support element 5 on which the four print heads 4*a*, 4*b*, 4*c* and 4*d* are fixed. Each print head is provided with ink of its own color, in this case cyan (C), magenta (M), yellow (Y) and black (K), respectively. The print heads are heated by heating means 9 which are disposed at the back of each print head 4 and on the support element 5. In addition, temperature sensors (not shown) are mounted on the carriage. The print heads are kept at the correct temperature via a control unit 10, with which the heating means can be individually activated in dependence on the temperature measured by the sensors.

Roller 1 is rotatable about its axis as shown by arrow A. In this way, the receiving material can be moved in the sub-scanning direction (X-direction) with respect to the support element 5 and hence also with respect to the print heads 4. The carriage 3 can be moved in reciprocation by suitable drive means (not shown) in a direction indicated by the double arrow B, parallel to roller 1. For this purpose the support element 5 is moved over the guide rods 6 and 7. This direction is termed the main scanning direction or Y-direction. In this way the entire receiving material can be scanned with the print heads 4.

In the embodiment as shown in the drawing, each print head 4 comprises a number of internal ink ducts (not shown) each provided with its own nozzle 8. In this embodiment, for each print head the nozzles form one row perpendicular to the axis of the roller 1 (sub-scanning direction). In a practical embodiment of an ink jet printer, the number of ink ducts per print head will be many times greater and the nozzles will be distributed over two or more rows. Each ink duct is provided with means (not shown) whereby the pressure in the ink duct can be suddenly raised so that ink drop is ejected through the nozzle of the associated duct in the direction of the receiving material. A means of this kind comprises, for example, a thermistor or a piezo-electric element. These means can be energised image-wise by an associated electrical drive circuit (not shown). In this way an image can be built up of ink drops on the receiving material 2.

When a receiving material is printed with a printer of this kind, ink drops being ejected from ink ducts, the receiving material, or part thereof, is (imaginarily) divided up into fixed locations forming a regular field of pixel rows and pixel columns. In one embodiment, the pixel rows are perpendicular to the pixel columns. The resulting separate locations can each be provided with one or more ink drops. The number of locations per unit of length in the directions parallel to the pixel rows and pixel columns is termed the resolution of the printed image, for example, indicated as 400×600 d.p.i. (dots per inch). By actuating a row of nozzles of a print head of the ink jet printer image-wise when the same is moving with respect to the receiving material, the support element 5 being displaced, a (sub-) image built up of ink drops forms on the receiving material, or at least on a strip of a width equal to the length of the nozzle row.

Figure 2:
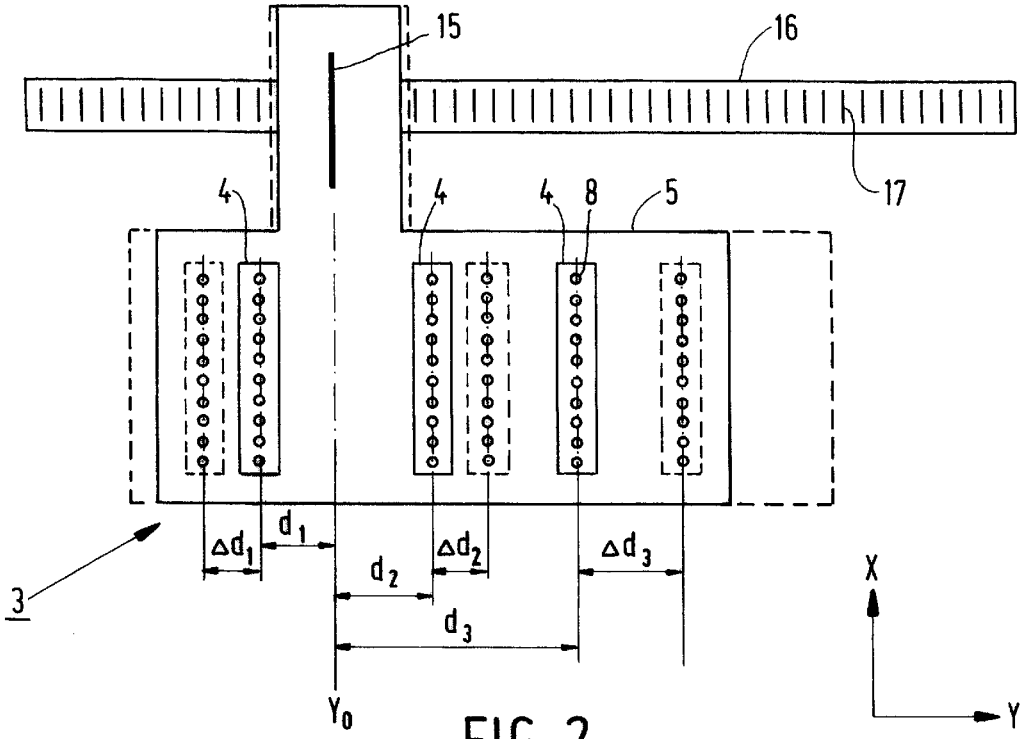
FIG. 2 is a diagram of a support element provided with a number of print heads.

As can be seen from FIG. 2, the support element 5 of carriage 3 has a projecting part provided with a reference mark 15 which is a fixed point of the support element. By means of this mark, a reference position Y0 is established in the Y-direction (main scanning direction) of each of the print heads. The absolute position of the fixed point 15 of the support element is defined by means of a linear encoder 16 which is provided with sensor means 17. In an alternative embodiment, it is possible to determine the position of the reference point 15 mechanically via a fixed transmission.

When the support element, which, in this embodiment, is an aluminum element in the form of a plate, is at room temperature, it has the shape indicated by the solid lines. The print heads 4 have a distance d1, d2 and d3, respectively, from the reference position Y0. As soon as the printer receives a print order, the print heads are heated to the working temperature. In these conditions the support element will also be heated because it is in thermal conduction with the print heads. As a result of this heating the support element expands until an equilibrium is reached, indicated by the broken lines. As a result of this expansion, the positions of the print heads with respect to the reference point change in amounts of Δd1, Δd2 and Δd3, respectively. If this expansion is disregarded in the actuation of the print heads, it results in the ink drops which are ejected by the print heads in the Y-direction each having a systematic deviation of Δd1, Δd2 and Δd3, respectively. In addition, these deviations will not be constant, but will vary in dependence on the circumstances. They can therefore be even greater or smaller. An average deviation in a support element made of aluminium (which has a relatively high coefficient of expansion), is in the tens of $\mu$m's at a temperature rise of the element of up to 80° C. Thus the distance between two adjacent print heads, which is typically 20 mm, is in a practical embodiment increased by 29 $\mu$m. The distance between the outermost print heads is enlarged by as much as 58 $\mu$m. This may appear small, but in view of the frequently used resolution of 400 dots per inch, i.e. one print location every 63 $\mu$m, it will be clear that such a deviation can lead to visible print artefacts, for example because the sub-images no longer exactly adjoin one another.

The expansion of the support element can of course also lead to errors in the X-direction and Z-direction (perpendicular to the X/Y plane), for example, as a result of the curvature of the support element. For reasons of simplification, these errors are not included in the example given. In principle, these deviations, however, can be avoided in the same way as the deviations described hereinbefore.

The present invention is not limited to the printer described above, in which the print heads are actively heated. The problem recognised by the Applicants can also occur in printers in which the heads are heated passively, for example by the surroundings. If, for example, the printer comprises a support element on which eight print heads are mounted relatively far apart, heating of this element due to the fact that the ambient temperature is higher than the room temperature (for example 35° C. as against 25° C.), can lead to a substantial mutual shift, particularly of the outermost print heads. This can also lead to visible print artefacts. These print artefacts can be avoided with the method according to the present invention.

Figure 3:
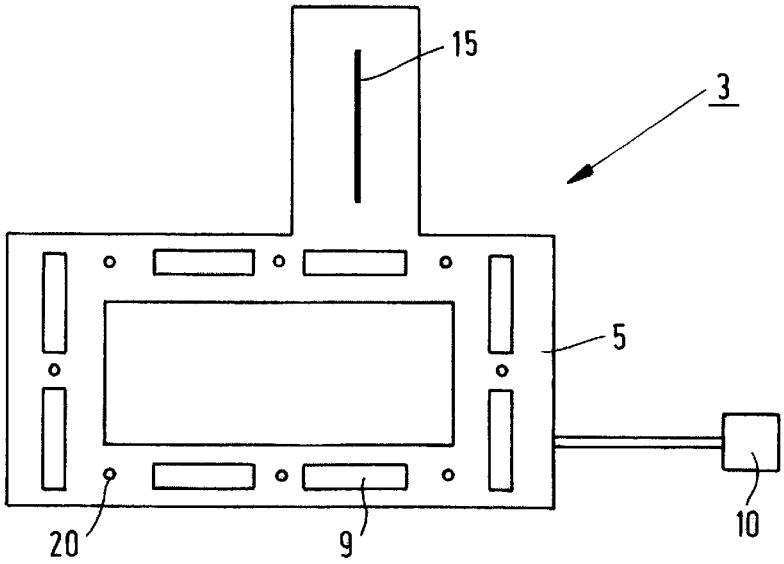
FIG. 3 is a diagram showing a support element forming part of an ink jet printer according to the present invention.

FIG. 3 shows the underside of a support element 5 of a carriage 3 suitable for performing the method according to the present invention. According to the present invention, the support element is provided with means to guarantee that the position occupied by each of the print heads with respect to the fixed point 15 on the support element during the printing of the receiving material is substantially a predetermined position.

As shown diagrammatically, the underside of the support element is provided with eight elongate heating elements 9 arranged over an aluminium frame forming the support element 5. The support element is also provided with eight temperature sensors 20, which in this specific example are mounted between the heating elements 9, so that the temperature of the support element can be directly or indirectly detected locally. Control unit 10 is connected to each of the thermal elements 9 and sensors 20. According to one embodiment of the present invention, prior to the printing of an image with the print heads which are fixed on the support element (not visible in this drawing), the support element is heated using the thermal elements until the support element has a predetermined temperature profile. This heating is controlled by control unit 10, which can individually actuate the thermal elements 9 in dependence on the local temperatures measured by the sensors and the temperature profile stored in its memory. Since the expansion of the support element 5 is determined substantially thermally, the shape of the support element is in this way also fixed as soon as the predetermined temperature profile is reached. As a result, the position of each print head with respect to the fixed point 15 of the support element is also fixed. If, after this heating of the support element, printing is started, these positions can be taken into account in the actuation of the print heads. By these means, controlled via unit 10, it is possible to ensure that the temperature profile of the support element is, under all circumstances, substantially equal, during printing, to the predetermined temperature profile as stored in the memory of unit 10. In this way the shape of the support element is fixed in every direction. In this way it is possible to completely avoid visible print artefacts as a result of a change of position of one or more of the print heads.

The temperature profile stored in the memory of control unit 10 must be determined prior to the actual printing of an order. This can be, for example, after completion of the production of the printer, if the most important variables influencing the position of the print heads on the support element are established. One method is to carry out an average job on the printer after production (average, for example, with respect to the size of the order, the print quality, type of image, and so on) under average ambient conditions, and to heat the support element in such manner that an optimal state is reached (for example with respect to power loss). The positions of the print heads with respect to the fixed point (for example a marker on one of the print heads) is then measured exactly, as is also the temperature profile of the support element. This profile is stored in the memory of unit 10. By imposing this temperature profile of the support element during each subsequent job, the associated positions of the print heads are immediately known (of course they are equal to the previously measured positions), and no appreciable deviations hereof need to be taken into account.

In addition to the above, it is advantageous to again establish the (optimal) temperature profile whenever an appreciable change occurs which has consequences for the position of the print heads, for example when a print head is replaced after a service call, or when the printer is placed in a room with different ambient conditions, when considerable wear has gradually occurred, and so on. This new profile will then replace the old profile stored in the memory of unit 10.

The number of heating elements and sensors required to be able to perform the method according to the present invention, and the way in which they are distributed over the support element 5, is dependent on a number of factors and will have to be determined by experiment. For example, it is clear to the skilled man that the shape of the support element and the material of which the element is made will influence the means required. If, for example, this material has good thermal conduction, then fewer sensors will be required because of better temperature uniformity over the element. Probably fewer heating elements will also be required if the element is made of a material having a lower coefficient of expansion. In addition to these factors, the configuration of the printer itself, for example, influences the means required. If the carriage as a whole, i.e. including the print heads and support element, is, for example, very well insulated thermally from its surroundings, so that reaching a stable temperature profile is less dependent on the instantaneous circumstances, then probably fewer thermal elements and/or sensors will be required in order to guarantee under all circumstances that the position occupied by each of the print heads with respect to a fixed point on the support element during the printing of the receiving material is substantially a predetermined position.

Figure 4:
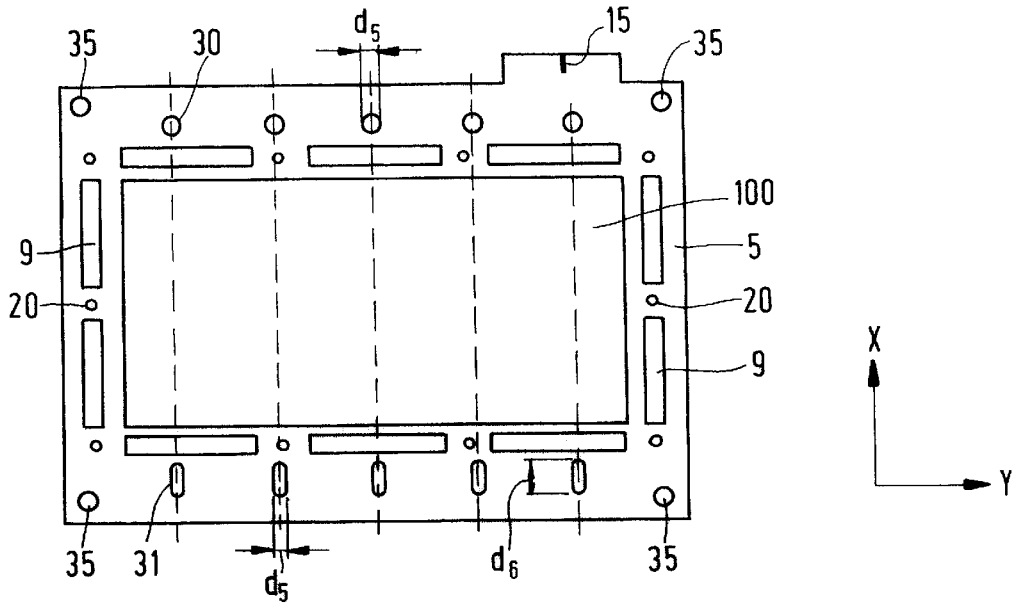
FIG. 4 is a practical embodiment of a support element for an ink jet printer according to the present invention invention.

FIG. 4 shows one practical embodiment of the support element 5 suitable for supporting five print heads. In this embodiment the support element consists of a rectangular frame with an opening 100 which is necessary to enable the print heads, at their back, to be supplied with liquid ink. The frame is provided with a projecting part with a reference point 15. At the corners, this element is provided with holes 35, by means of which the element is fixed on a following part of the carriage. In this embodiment, the support element is provided with ten thermal elements 9 and ten sensors 20.

To fix the print heads, the support element is provided with five round holes 30 having a diameter d5 and spaced a fixed distance apart in the Y-direction. Corresponding to these holes 30, five slots 31 are provided at the other end of the support element (looking in the X-direction) and have a diameter d5 in the Y-direction and a larger diameter d6 in the X-direction.

Figure 5:
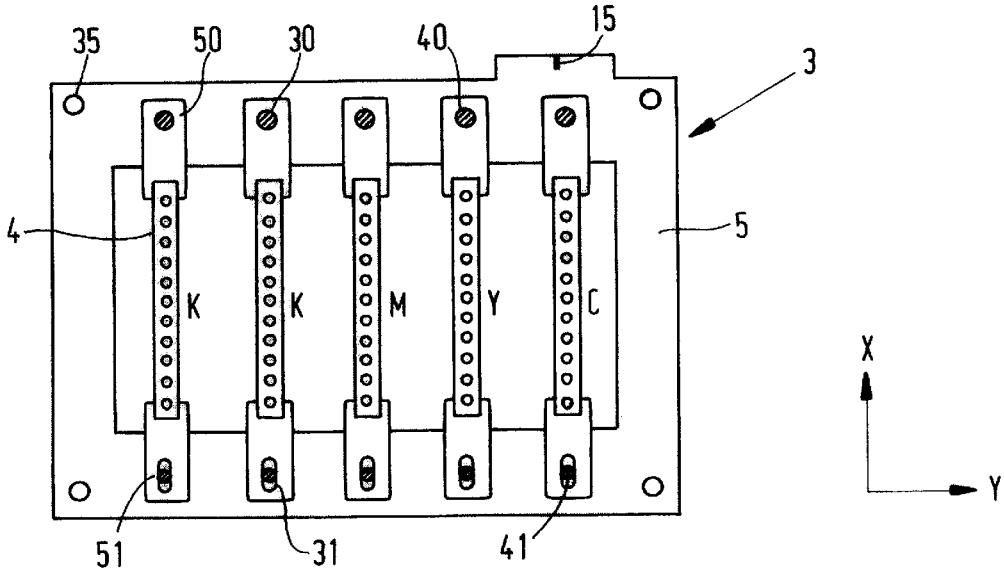
FIG. 5 shows the support element of FIG. 4 provided with a number of print heads.

FIG. 5 again shows the support element of FIG. 4. To simplify the drawing, the thermal elements 9 and the sensors 20 are no longer shown in this drawing.

In this Figure, five print heads are fixed on the support element according to a first embodiment. Each of the print heads 4, in this embodiment two black (K), one magenta (M), one yellow (Y) and one cyan (C), is provided with fixing elements 50 and 51 which are in turn provided with the pins 40 and 41. These pins coincide with the centers of the holes 30 and 31, respectively. The diameters of the pins 40 are such that they fit with a clamping action in the holes 30. The pins 41 and the holes 31 are of such shape that they can move in the X-direction with respect to one another. This possibility of movement is provided to prevent the print heads 4 from being excessively stressed due to the expansion and shrinkage of the support element and the print heads themselves. Thus the print heads are fixed in the Y-direction (main scanning direction) on the support element and the print heads can move in the X-direction with respect to the support element. Nevertheless, the position of each print head is fixed under all circumstances because each print head is fixed with respect to the reference point 15 in the Y-direction, fixed with respect to the holes 30 in the X-direction, the holes in turn being fixed with respect to the reference point, and in the Z-direction because the entire form is defined, according to the method of the present invention, during printing.

Figure 6:
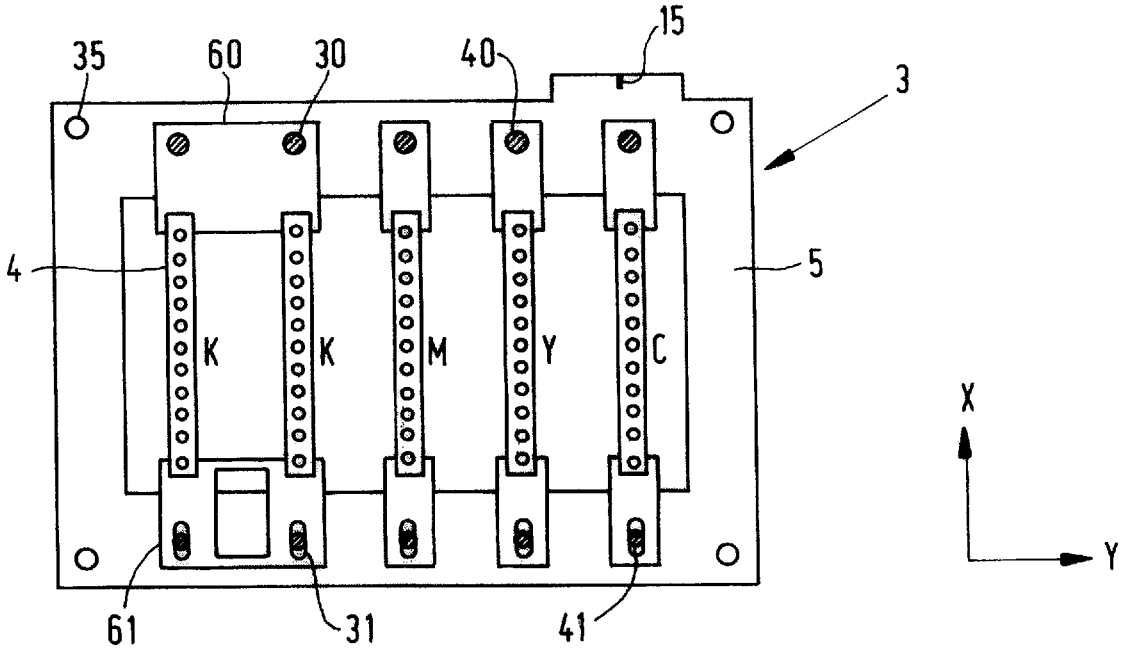
FIG. 6 shows the support element of FIG. 4 provided with a number of print heads in an alternative manner.

FIG. 6 shows an embodiment of the support element provided with five print heads. In this embodiment, the support element 5 does not differ from the support element shown in FIGS. 4 and 5. Only the fixing system of the two black print heads differs from that shown in FIG. 5. In this embodiment, the two black print heads are interconnected via common fixing elements 60 and 61. These elements are in turn provided with pins 40 and 41 coinciding with the holes 30 and 31 in the support element. In this embodiment, the mutual position of the black print heads is effectively guaranteed and both heads can easily be removed, simultaneously, from the support elements. If necessary, the elements 60 and 61 can be provided with additional means to control the expansion and shrinkage of these elements according to the invention.

Many alternatives are possible for the embodiments illustrated. For example, a print head can be fixed on the support element using thermal insulation. The print head can be fixed on the support element releasably or fixedly. It is also possible to fix more than two print heads on the support element using subframe. The support element also can form part of the carriage in various ways, as a supporting part or as a subframe, releasably fixed or integrated, suspended resiliently or rigidly, thermally insulated or just in conductive contact with the other parts of the carriage, and so on. All these and other alternatives do not form part of the present invention.

What is claimed is:

1. A method of printing a receiving material using an ink jet printer provided with a print head having at least one print element, said print head being fixed on a support element having a fixed reference point, the method comprising:

heating the print head to a working temperature higher than room temperature, moving the support element with respect to the receiving material in a main scanning direction and in a sub-scanning direction, actuating the print element, image-wise, so that ink drops are ejected from the print head in the direction of the receiving material, and guaranteeing that the position that the print head occupies with respect to the fixed reference point on the support element during the printing of the receiving material is substantially a predetermined position.

2. The method according to claim 1, wherein a predetermined temperature profile is substantially imposed on the support element during the printing of the receiving material.

3. The method according to claim 2, wherein the temperature profile comprises a temperature higher than room temperature.

4. The method according to claim 3, wherein a temperature substantially equal to the working temperature of the print head is imposed on the support element.

5. An ink jet printer for printing a receiving material which comprises:

a print head with at least one print element for ejecting ink drops in the direction of the receiving material, a support element on which the print head is fixed, said support element containing a fixed reference point, a first heating means for heating the print head to a working temperature higher than room temperature, a movement means for moving the support element containing the print head with respect to the receiving material in a main scanning direction and in a sub-scanning direction, wherein the printer comprises a guarantee means for guaranteeing that the position that the print head occupies with respect to said fixed point on the support element during the printing of the receiving material is substantially a predetermined position.

6. The ink jet printer according to claim 5, wherein the guarantee means comprises a second heating means for imposing a substantially predetermined temperature profile on the support element during the printing of the receiving material.

7. The ink jet printer according to claim 6, wherein the temperature of the support element during the printing of the receiving material is substantially equal to the working temperature of the print head.

8. The ink jet printer according to claim 5, wherein at least two print heads are fixed on the support element.

9. The ink jet printer according to claim 8, wherein the print heads are fixed on the support element at least in the main scanning direction.

10. The ink jet printer of claim 6, wherein the second heating means comprises a plurality of thermal elments and heat sensors uniformly distributed on the support element, said thermal elements and heat sensors being connected to a control unit to ensure the integrity of the temperature profile of the support element.

* * * * *